US005121917A

United States Patent [19]

Gray

[11] Patent Number: 5,121,917

[45] Date of Patent: Jun. 16, 1992

[54] JUMPING MACHINE

[76] Inventor: Robert T. Gray, P.O. Box 531, Bryans Road, Md. 20616

[21] Appl. No.: 625,544

[22] Filed: Dec. 11, 1990

[51] Int. Cl.[5] ..... A63B 5/20

[52] U.S. Cl. ..... 482/81; 482/3

[58] Field of Search ..... 434/247; 128/24 R; 272/74, 75, 143, DIG. 5, 93, 38, 88; 475/331, 317

[56] References Cited

U.S. PATENT DOCUMENTS

| | | | |
|---|---|---|---|
| 236,259 | 1/1881 | Reid | 475/331 X |
| 2,911,063 | 11/1959 | Wolfson | 272/75 |
| 3,013,798 | 12/1961 | Willoughby | 272/74 |
| 3,072,402 | 1/1963 | McCombs | 272/74 |
| 3,411,755 | 11/1968 | Delk, Jr. | 272/75 |
| 3,610,616 | 10/1971 | Evans | 272/75 |
| 3,612,522 | 10/1971 | Ekonen | 272/75 |
| 3,964,742 | 6/1976 | Carnielli | 272/73 |
| 4,193,324 | 3/1980 | Marc | 475/331 X |
| 4,529,195 | 7/1985 | Stevens | 272/75 |
| 4,718,655 | 1/1988 | Airy et al. | 272/132 |
| 4,739,985 | 4/1988 | Rudell et al. | 272/74 |

FOREIGN PATENT DOCUMENTS

| | | | |
|---|---|---|---|
| 0227726 | 10/1910 | Fed. Rep. of Germany | 272/74 |
| 2745145 | 6/1978 | Fed. Rep. of Germany | 272/74 |

*Primary Examiner*—Cary E. O'Connor
*Assistant Examiner*—L. Thomas
*Attorney, Agent, or Firm*—Nicholas J. Aquilino

[57] ABSTRACT

A jumping machine for assisting handicapped children or children with motor deficiencies in learning how to jump rope. The machine includes a rigid or semi-rigid U-shaped jumping loop pivotally connected to a support frame. The jumping loop having handles which can be grasped by the user in order to control the position of the jumping loop.

20 Claims, 2 Drawing Sheets

JUMPING MACHINE

BACKGROUND OF THE INVENTION

The present invention relates to a jumping device for aiding children in learning how to jump rope The invention was developed as a result of working with handicapped children and children with motor deficiencies and seeing their enormous frustration in learning how to jump a rope It was discovered that these children could not jump a regular jump rope due to its flexibility. The children could not control the rope, and thereby became discouraged. Therefore, a more solid form of rope was needed which led to the development of the rigid jumping loop.

Even though the rigid jumping loop was beneficial for some children, there were many others who could not perform using this more solid form of rope. Still needed was a method for slowing down the travel of the rope and providing even more control so that children at all levels of ability could learn to jump rope. By providing rigid handles on the jumping loop and pivotally supporting the jumping loop on a stable support frame a child need only concentrate on timing his or her jump to correspond with the stable controlled movement of the jumping loop.

At the present, there are no other devices known of for training children with limited physical abilities how to jump rope. There are other mechanical jump ropes such as German patent DT2745145 to Hauswirth and the U.S. Pat. No. 3,013,798 to Willoughby, but neither are for aiding the development of a child in learning how to jump rope and do not offer any degree of control to the user for assisting in learning.

Therefore, the present invention sets forth to overcome the problems neither recognized or solved by the prior art.

SUMMARY OF THE INVENTION

The invention pertains to a jumping machine for assisting children with limited physical abilities learn how to perform the task of jumping a rope. The present invention does this by providing a rigid generally U-shaped jumping loop pivotally supported and stabilized by a support frame structure.

The jumping loop is provided with rigid handles which the user grasps during operation, thus enabling the user to have a high degree of control over the speed and direction of travel of the jumping loop.

It is an object of this invention to provide a machine which simulates jumping rope for mildly handicapped children or children with motor deficiencies in order that they may build and develop their hand/eye coordination, bilateral coordination, and sense of rhythm and timing.

It is a further objective to develop a child's motor skills while providing physical exercise and at the same time teach a child how to jump rope.

DETAILED DESCRIPTION OF THE PREFERRED EMBODIMENTS

Figure 1:
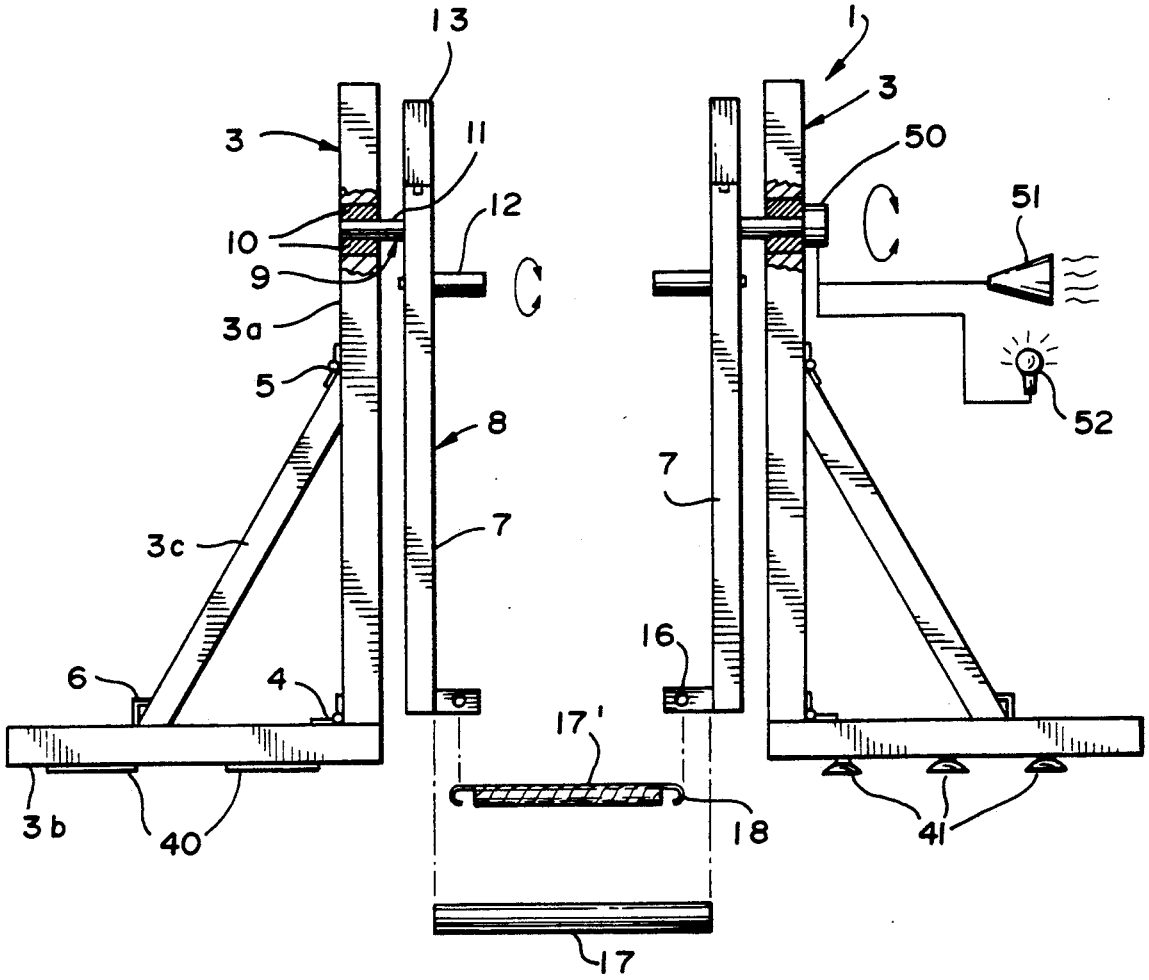
FIG. 1 is a front view of the jumping machine.

In accordance with the preferred embodiment, the jumping machine 1 includes a support frame 3 which may be constructed from any suitable material such as wood, metal or plastic, as long as it provides a sufficiently stable support.

The support frame 3 includes a base **3*b* pivotally connected to a vertical member 3*a* by hinge 4. The vertical member includes a cross bar 30 hinged thereto at 5. The crossbar 3*c* engages a raised channel 6 in the base 3*b* when the support frame 3 is set up in the operating position When not in use the support frame 3 may be collapsed for ease in transportation and storage. The support frame 3 can be attached to the surface upon which it rests by a variety of anchoring means depending upon the type of surface. For example, if the surface is carpeted VELCRO strips 40, that is a hook typed fastener, could be attached to the underside of base 3*b* or if the surface is a gymnasium floor rubber suction cups 41 could be substituted for the VELCRO strips 40**.

The support frame 3 pivotally supports a jumping loop 8 by a pivotal connection 9 a sufficient distance above the surface upon which the support frame 3 rests in order to allow the jumping loop 8 to travel without striking the surface. The pivotal connection 9 includes bearing members 10 which rotatable support rod 11 which is attached at one end to jumping loop 8.

The jumping loop 8 is generally U-shaped and includes a pair of legs 7 and a cross member 17 or 17' connecting the two legs 7 at one end thereof. Cross member 17 is made from a rigid or semi-rigid material, whereas cross member 17' is made from a flexible material, such as rope, so long as it provides an exact horizontal target for the user to jump over. The legs 7 may also be made from a rigid or semi-rigid material, such as wood, plastic or metal. One material found suitable for jumping loop 8 is PVC tubing which may be brightly colored in order to aid the user in visually establishing when to jump the cross member 17. The ends of legs 7 may include a projection 16 with a hole therethrough in order to allow the hooks 18 of cross member 17, to be attached thereto. The cross member 17 may be attached to legs 7 by any conventional means. As shown it is hollow and of such length that it may be slid over the projection 16. The cross members 17 or 17' could also be mounted in such a fashion that they could break away from legs 7 in order to prevent any injury to a user who forgets to jump or mistimes their jump. One such mounting means would involve the use of magnets attached to both legs 7 and cross members 17 or 17' or more simply, the cross members could be attached by a hook and loop type fastener 45 as shown in FIG. 2.

The legs of jumping loop 8 have handles 12 affixed thereto for rotating the jumping loop 5. The handles 12 may be connected in a similar manner to bicycle pedals, that is, a rigid attachment which can rotate about a central horizontal axis or they may be rigidly attached. The handles 12 are rigid, thereby allowing the user to have total control of the jumping loop 8. The user is able to push and pull the jumping loop 8 in either direction as well as control the speed of the loop, which aids the user in his or her jump timing. Also, by having control over the movement of the jumping loop 8, the process of determining the visual information necessary for jumping the loop 8 is made easier. The handles 12 are mounted to the legs 7 at a point below the pivotal connection 9 and are located on the inside of the jumping loop 8, projecting inwardly towards one another.

Counterweights 13 are located at the upper ends of legs 7. These weights are effective to counterbalance the weight of the rigid loop about the pivotal connection 9, thereby making movement of the jumping loop easier for children having reduced physical ability.

Figure 2:
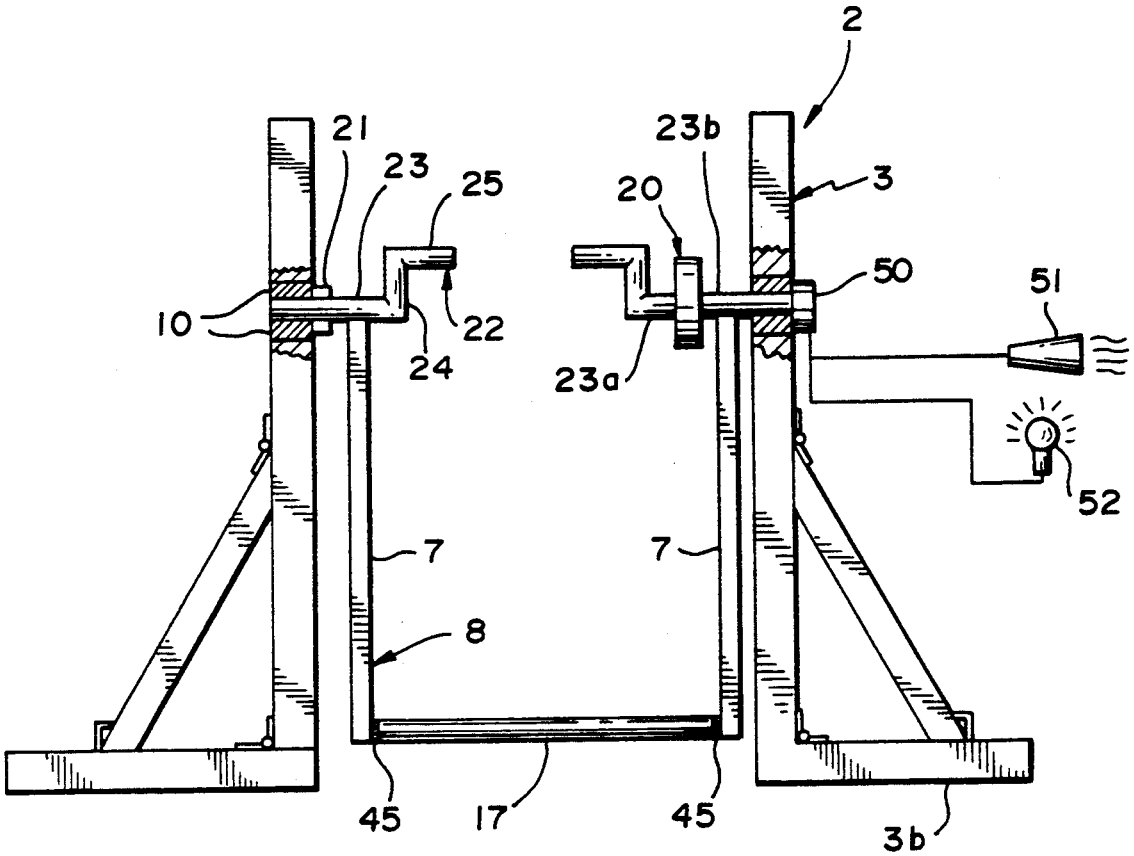
FIG. 2 is a front view of a second embodiment of the jumping machine.

The second embodiment of the jumping machine 2 shown in FIG. 2 is similar in design, however the means for connecting the jumping loop 8 to the support frame 3 has been modified to include the handles.

The pivotal connection means 22 includes horizontal portion 23 which cooperates with bearing 10 in order to form a pivotal connection for rotatably securing jumping loop 8 to support frame 3. The handle 25 which functions as a user gripping surface is connected to the horizontal portion 23 by a vertical spacing member 24. The length of the spacing member 24 may be adjustable.

The horizontal portion 23 may also include an optional one-way clutch 21 and/or an optional planetary gear arrangement 20.

The one-way clutch 21 functions to allow jumping loop 8 to turn only in a clockwise direction, thus eliminating the mental step involved in figuring out which way to turn the loop while learning how to jump rope.

Figure 3:
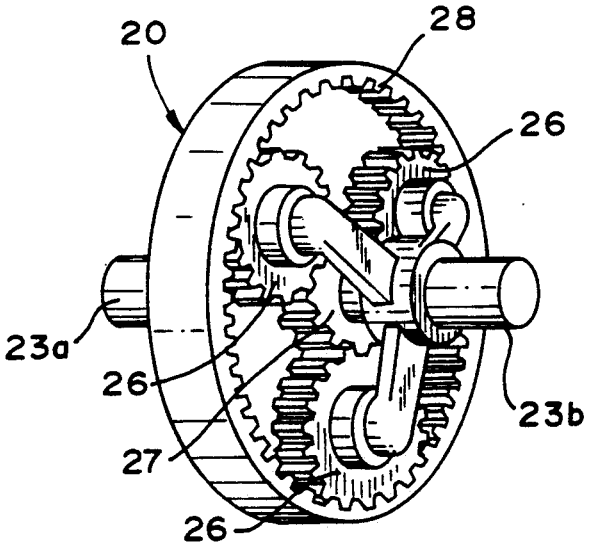
FIG. 3 is an exploded view of the planetary gears used in the second embodiment shown in FIG. 2.

The planetary gear arrangement 20 is connected so as to divide the horizontal portion 23, which can best be seen in FIG. 3. Segment **23*b* has one end rotatably connected to the support frame 3 at bearing 10. The other end of segment 23*b* has a plurality of gears 26 which engage an outerdrum 28. A inner gear 27 attached to the end of segment 23*a*. Inner gear 27 cooperates with gears 26 to thereby connect segment 23*b* to segment 23*a*. The purpose of this planetary gear arrangement 20 is to make rotation of the jumping loop 8** easier for disabled users. The gears provide a mechanical advantage as well as vary the speed ratio between the handles and the jumping loop, thus allowing children with limited physical strength to use the jumping machine.

The jumping machine may also incorporate a sensor which can sense the position of the jumping loop 8 to give an audible or visual signal at the appropriate time to jump. This feature further aids a disable child or child with motor deficiencies learn how to jump rope and provides good exercise.

A conventional rotation position sensor 50 can be positioned to sense the rotation of horizontal portion 23 or support rod 11 and at a predetermined position send a signal through lines 55 which triggers an audible signal 51 or visual signal 52.

To operate the jumping machine, the user stands between legs 7 and grasps handles 12 or 25, then begins rotating the jumping loop 8 as one would rotate a jump rope, jumping over crossbar 17 at the appropriate time. The user has complete control of the location of the jumping loop 8 due to the overall construction of the jumping machine which facilitates and accelerates the process of learning how to jump rope.

While various preferred embodiments have been shown and described, it will be understood that there is no intent to limit the invention by such disclosure but, rather, it is intended to cover all modifications and alternate constructions falling within the spirit and scope of the invention as defined in the appended claims.

I claim:

1. A jumping machine for assisting children in learning how to jump rope comprising:

a support frame;

a generally U-shaped jumping loop having a pair of legs and a cross member;

a pivotal connection means for attaching said jumping loop to said support frame;

rigid handles rigidly attached to cooperate with the legs of said jumping loop; and said handles projecting inwardly of the jumping loop so that a user may grasp the handles to rotate and to precisely control the movement of the jumping loop.

2. The invention of claim 1, wherein said pivotal connection means includes a one-way clutch.

3. The invention of claim 1, wherein said pivotal connection means includes a planetary gear arrangement.

4. The invention of claim 1, wherein handles are rigidly attached to said pivotal connection means by a adjustable vertical member.

5. The invention of claim 1, wherein said handles are connected to the legs of said U-shaped jumping loop and are free to rotate about a horizontal axis.

6. The invention of claim 1, wherein the cross member is attached to the legs of said jumping loop by a break-away connection means.

7. The invention of claim 1, further including a sensor for producing a signal to indicate when to jump.

8. The invention of claim 1, wherein the legs are rigid and the cross member is flexible.

9. The invention of claim 1, wherein the legs include counterweights at their ends.

10. A jumping machine for assisting children in learning how to jump rope comprising:

a support frame;

a generally U-shaped jumping loop having a pair of rigid legs and a cross member;

a pivotal connections means for attaching said jumping loop to said support frame; and handles projecting inwardly towards one another and are attached to cooperate with the legs of said jumping loop at a location spaced from the pivotal connection means.

11. The invention of claim 10, wherein said pivotal connection means includes a one-way clutch.

12. The invention of claim 10, wherein said pivotal connection means includes a planetary gear arrangement.

13. The invention of claim 10, wherein handles are rigidly attached to said pivotal connection means by an adjustable vertical member.

14. The invention of claim 10, wherein said handles are connected to the legs of said U-shaped jumping loop and are free to rotate about a horizontal axis.

15. The invention of claim 10, wherein the cross member is attached to the legs of said jumping loop by a break-away connection means.

16. The invention of claim 10, wherein said cross member is flexible.

17. The invention of claim 10, wherein said cross member is rigid.

18. The invention of claim 10, wherein said legs include counterweights at their ends.

19. The invention of claim 10, further including a sensor for producing a signal to indicate when to jump.

20. A jumping machine for assisting children in learning how to jump rope comprising:

a support frame;

a rigid, generally U-shaped jumping loop having a pair of legs and a cross member;

a pivotal connections means for attaching said jumping loop to said support frame; and handles attached to cooperate with the legs of said jumping loop at a location spaced from the pivotal connection means and projecting inwardly towards one another to be grasped by the user during operation.

* * * * *